US008702069B1

(12) United States Patent
Byers

(10) Patent No.: US 8,702,069 B1
(45) Date of Patent: Apr. 22, 2014

(54) GUARD RAIL SYSTEM

(76) Inventor: Thomas L. Byers, Mustang, OK (US)

( * ) Notice: Subject to any disclaimer, the term of this patent is extended or adjusted under 35 U.S.C. 154(b) by 689 days.

(21) Appl. No.: 12/276,758

(22) Filed: Nov. 24, 2008

Related U.S. Application Data

(60) Provisional application No. 60/990,347, filed on Nov. 27, 2007.

(51) Int. Cl.
*E04H 17/00* (2006.01)

(52) U.S. Cl.
USPC ..... 256/65.14; 52/20

(58) Field of Classification Search
USPC ..... 256/23, 57, 65.01, 65.02, 65.03, 65.04, 256/65.05, 65.11, 65.13, 65.14, 67, DIG. 6; 182/113; 52/19, 20; 49/55; 248/235
See application file for complete search history.

(56) References Cited

U.S. PATENT DOCUMENTS

| | | | | | |
|---|---|---|---|---|---|
| 276,073 | A * | 4/1883 | Power | 49/10 |
| 1,633,000 | A * | 6/1927 | Culver | 256/64 |
| 2,321,221 | A * | 6/1943 | Linehan | 403/230 |
| 3,474,473 | A * | 10/1969 | Hannaberg | 5/426 |
| 3,757,894 | A * | 9/1973 | Chamberlin | 182/106 |
| 4,034,829 | A * | 7/1977 | Hoffman | 182/106 |
| 4,359,851 | A * | 11/1982 | Daniels | 52/298 |
| 4,787,475 | A * | 11/1988 | Arteau et al. | 182/82 |
| 5,282,339 | A * | 2/1994 | Devlin et al. | 52/20 |
| 5,435,028 | A * | 7/1995 | Frala | 5/662 |
| 5,913,508 | A * | 6/1999 | Eades | 256/65.06 |
| 6,068,084 | A * | 5/2000 | Taormina | 182/113 |
| 6,167,659 | B1 | 1/2001 | Swindell, III | |
| 6,272,800 | B1 | 8/2001 | Phinney et al. | |
| 6,311,449 | B1 * | 11/2001 | Morse et al. | 52/702 |
| 6,425,572 | B1 * | 7/2002 | Lehr | 256/1 |
| 6,467,230 | B1 | 10/2002 | Perkins et al. | |
| 6,681,528 | B1 | 1/2004 | Profeta et al. | |
| 6,931,793 | B2 | 8/2005 | Joyce et al. | |
| 7,066,299 | B1 | 6/2006 | Fleming | |
| 7,077,239 | B1 | 7/2006 | Hayman et al. | |
| 7,171,705 | B1 | 2/2007 | Hicks | |
| 7,300,037 | B2 * | 11/2007 | Beirne et al. | 256/64 |
| 7,516,575 | B2 * | 4/2009 | Cuccurullo | 52/20 |
| 7,856,763 | B2 * | 12/2010 | Keys et al. | 52/92.2 |
| 2004/0104382 | A1 * | 6/2004 | Collins et al. | 256/59 |
| 2006/0174580 | A1 * | 8/2006 | Quertelet et al. | 52/698 |
| 2010/0155176 | A1 * | 6/2010 | Lohr et al. | 182/113 |

* cited by examiner

*Primary Examiner* — Michael P Ferguson
*Assistant Examiner* — Daniel Wiley
(74) *Attorney, Agent, or Firm* — Hall Estill Attorneys at Law

(57) ABSTRACT

Apparatus and method for providing a guard rail adjacent an access aperture extending through a floor surface, such as in an attic space of a residential structure. A guard rail assembly includes a top rail portion which extends adjacent at least one side of the access aperture to provide a guard rail. An angled portion extends at a non-orthogonal angle to provide a hand grip surface for a user passing through the access aperture. A front leg segment supports an end of the angled portion opposite the top rail portion. Preferably, a rear leg segment supports the top rail portion to form a first side rail assembly. A second, nominally identical side rail assembly adjoins the first side rail assembly to form a substantially u-shaped top rail surface that surrounds the access aperture on three sides. The guard rail assembly is further preferably adjustable to accommodate different access aperture dimensions.

27 Claims, 6 Drawing Sheets

GUARD RAIL SYSTEM

RELATED APPLICATIONS

The present application claims the benefit of and incorporates by reference U.S. Provisional Patent Application No. 60/990,347 filed Nov. 27, 2007 entitled Guard Rail System.

BACKGROUND

The ability to safely and efficiently access an elevated surface continues to be a goal of the general public. Such elevated surfaces are often accessed using a set of stairs, or a ladder, to provide access to the surface.

Many residential applications provide an attic space over a garage or other part of the residential structure. In such cases, a set of retractable attic stairs can often be pulled down and extended to provide a ladder-like staircase. Generally, the user ascends the stairs to enter the attic space through an access aperture extending through the attic floor (and the ceiling of the lower level).

It is often the case that the attic stairs will remain in this extended position so long as the user remains in the attic, to enable the user to eventually leave the attic and return to the lower floor. While the user is occupied with activities within the attic such as manipulating objects stored there, bringing objects up to the attic or retrieving objects down from the attic, the user will generally need to take care not to inadvertently step through the open attic access aperture and fall down the stairs to the lower surface.

The lack of a railing around an open aperture in a raised surface such as an attic floor can increase the chances of serious accident or death for anyone who ascends onto such surface. The dangers have been recognized by international safety organizations such as the International Code Council. In 2006, the International Code Council adopted residential building codes that specify guard rails around all raised floor surfaces over 30 inches above the floor. Similarly, the International Code Council adopted codes that specify a handrail to extend from above a bottom step to above a top step at a minimum height of 36 inches.

Attempts have been made in the art to provide safety railings around apertures in elevated surfaces, such as exemplified by U.S. Pat. Nos. 6,681,528 and 6,272,800. Nevertheless, there remains a continued need for improvements in the art to address these and other considerations, including but not limited to residential attic spaces.

SUMMARY

In accordance with various embodiments of the present invention, an apparatus and method are directed to providing a guard rail adjacent an access aperture extending through a floor surface, such as in an attic space in a residential structure.

In accordance with some embodiments, a guard rail assembly is provided with a top rail portion which extends adjacent at least one side of the access aperture to provide a guard rail. An angled portion extends at a non-orthogonal angle to provide a hand grip surface for a user passing through the access aperture. A front leg segment supports an end of the angled portion opposite the top rail portion.

In further embodiments, a rear leg segment supports the top rail portion to form a first side rail assembly. A second, nominally identical side rail assembly adjoins the first side rail assembly to form a substantially u-shaped top rail surface that surrounds the access aperture on three sides. In still further embodiments, the guard rail assembly is adjustable to accommodate different access aperture dimensions.

These and various other features and advantages which characterize various embodiments of the present invention can be gleaned from a review of the following detailed discussion and associated drawings.

DETAILED DESCRIPTION

Various embodiments of the present invention are generally directed to a guard rail system configured to provide protective railing about an access aperture in a floor surface, such as an attic access aperture for an attic space in a residential structure. It will be appreciated, however, that such is merely for purposes of illustration and is not limiting to the scope of the claimed subject matter.

Figure 1:
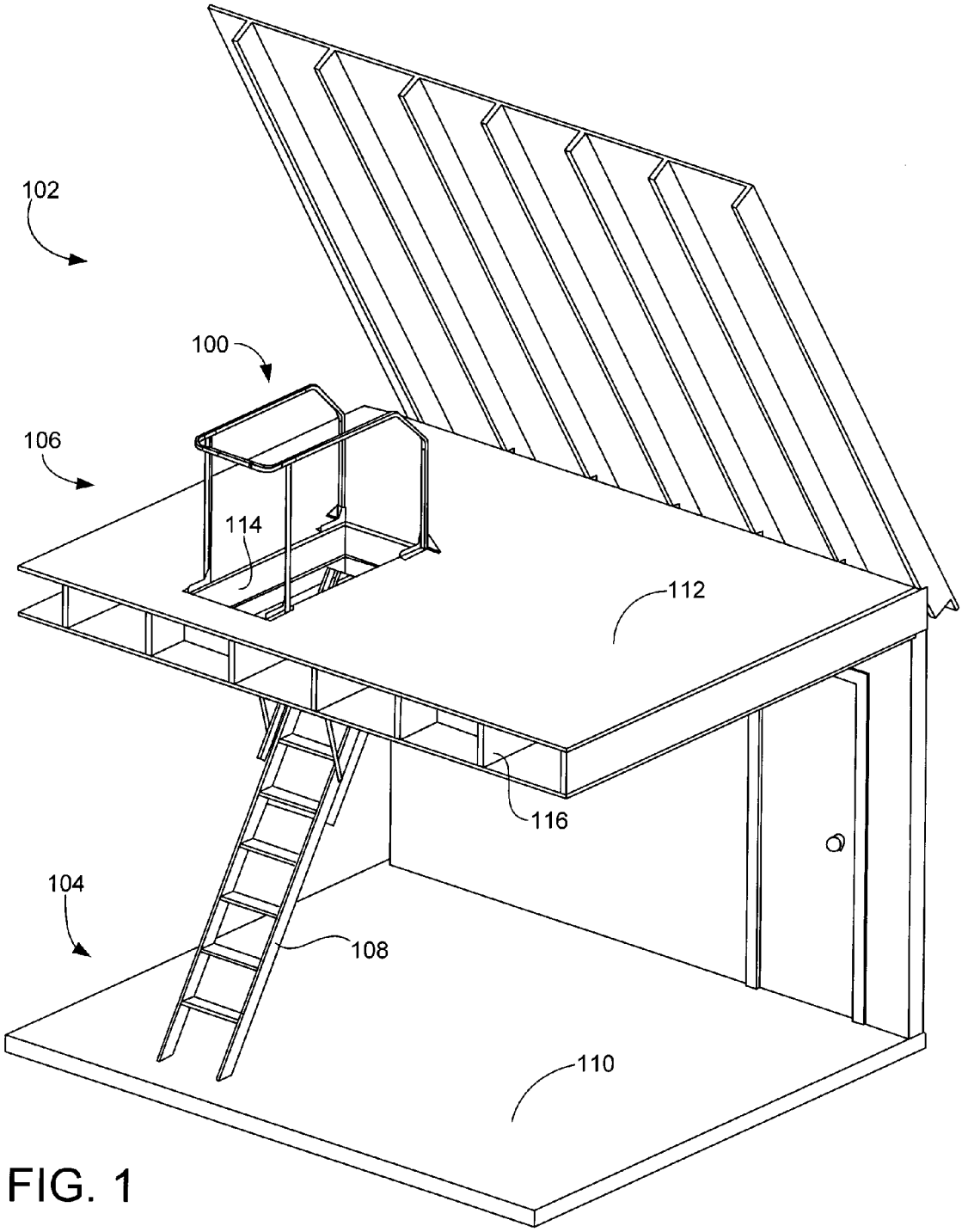
FIG. 1 is an isometric view of a guard rail assembly constructed in accordance with various embodiments of the present invention to provide protection for a user accessing an attic space in a residential structure.

FIG. 1 shows an exemplary guard rail assembly 100 constructed in accordance with preferred embodiments of the present invention. The guard rail assembly 100 is shown in FIG. 1 to be utilized in the environment of a residential structure 102 with a garage 104. An attic space is provided above the garage 104 to provide the homeowner or other user a suitable storage space for objects not normally needed on a day-to-day basis (such as boxes of seasonal decorations, etc.).

The attic 106 is preferably accessed by way of retractable attic stairs 108 that are pulled down and extended to provide a ladder-like staircase. A user ascends the stairs 108 from a lower surface (e.g., garage floor) 110 to an upper surface (e.g., attic floor) 112 through an attic access aperture 114.

As is conventional in the art, the attic floor 112 is preferably supported by a series of laterally extending joists 116. The attic access aperture 114 is preferably sized to fit between an adjacent pair of these joists, as shown. The exemplary attic access aperture 114 is rectangular in cross-section with dimensions substantially matching the dimensions of the attic stairs 108 when the stairs are collapsed in their normally stored position; that is, the collapsed stairs 108 preferably "nest" within the attic access aperture 114 when folded into the retracted state. This is not necessarily required, however.

Figure 2A:
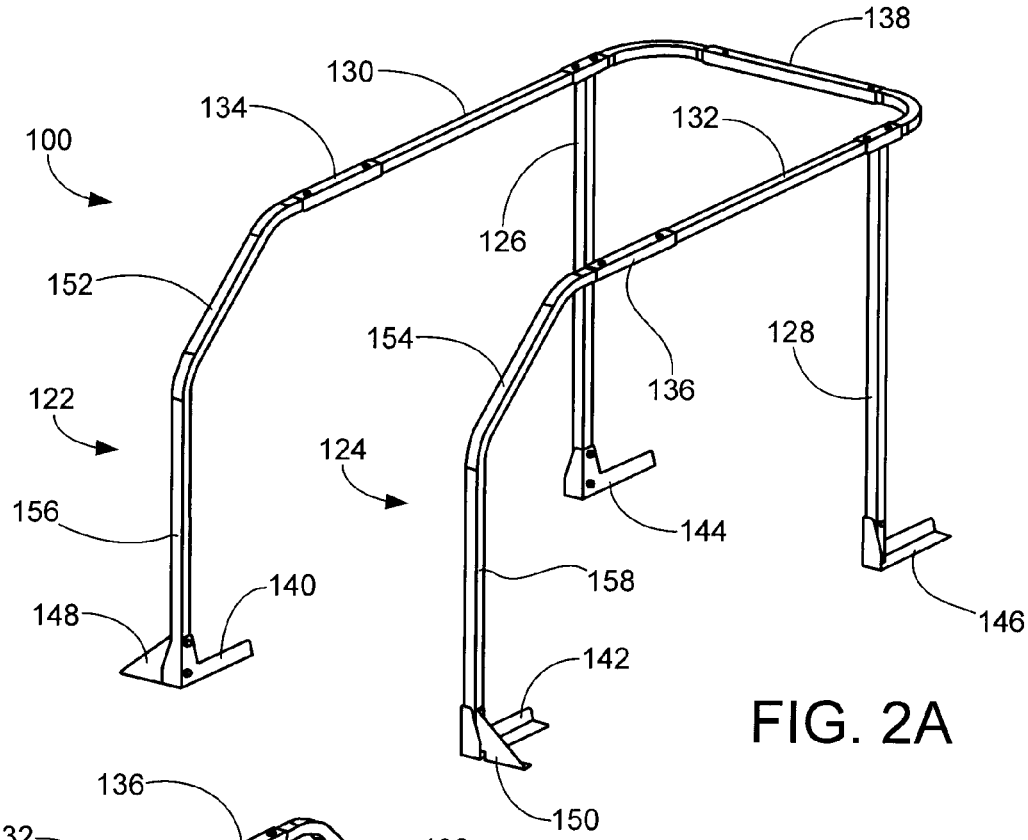
FIGS. 2A and 2B provide respective frontward and rearward views of the guard rail assembly of FIG. 1.
Figure 2B:
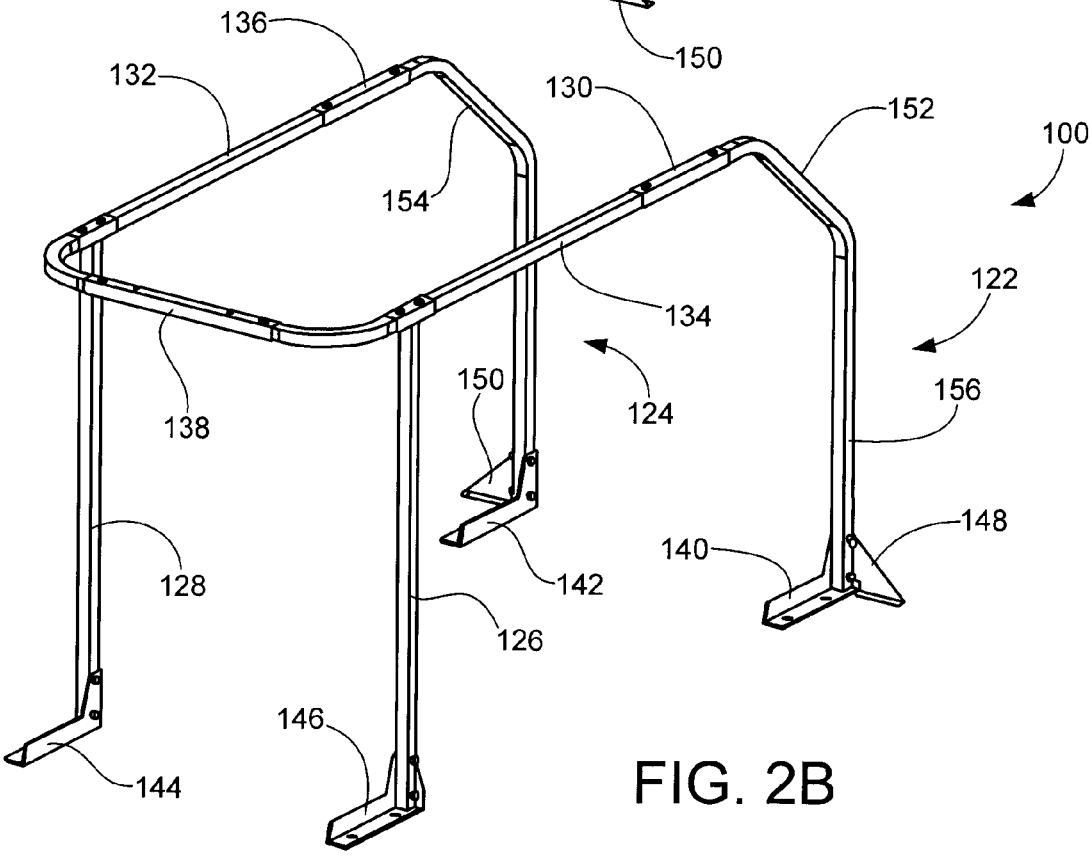
Figure 3:
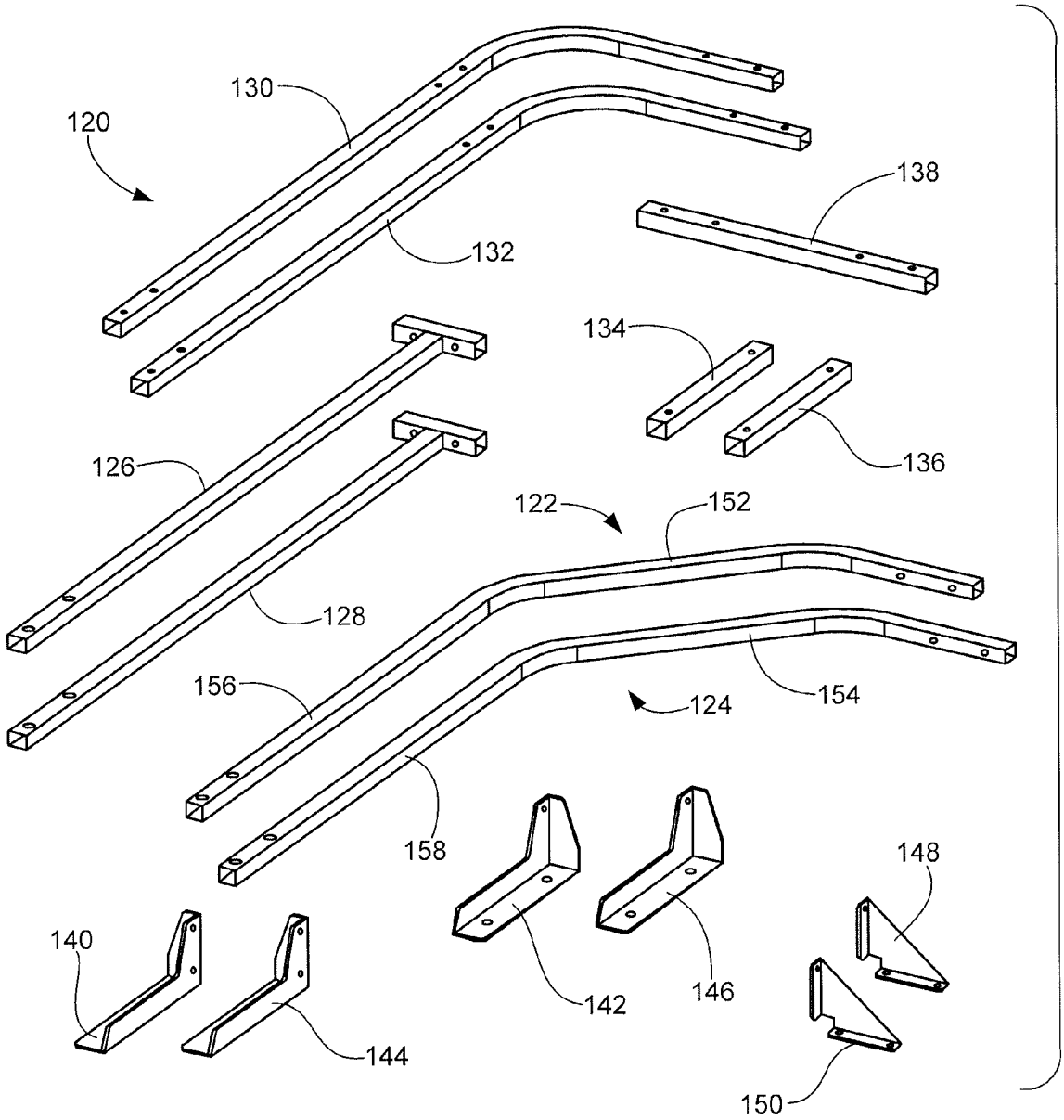
FIG. 3 generally illustrates preferred constituent parts of the guard rail assembly when provisioned to the user as a kit.

The guard rail assembly 100 is shown in greater detail in the isometric depictions of FIGS. 2A and 2B. While in some embodiments the guard rail assembly 100 can be provided as a single, one-piece unit, the guard rail assembly 100 is preferably provided as a kit of components 120, as generally illustrated in FIG. 3, which are assembled on-site by or on behalf of the user as discussed below.

The guard rail assembly 100 as exemplified in FIGS. 2A and 2B includes a pair of opposing front leg portions 122 and 124; a pair of opposing rear leg portions (segments) 126 and 128; a pair of opposing top rails 130 and 132; adjustable attachment members ("joiners") 134, 136 and 138; floor support brackets 140, 142, 144 and 146; and stabilizer brackets 148 and 150.

These various components are preferably formed from tubular metal stock of suitable strength and cross-sectional size. In some embodiments, the legs and rails are formed of ⅞ inch square stock and the joints are formed of 1 inch square stock, although other shapes and sizes can be used including round stock, etc. The various components are connected to each other and to the floor surface 112 using various suitable fasteners which extend through apertures as noted below.

The guard rail assembly 100 is oriented so the front leg portions 122 and 124 are located adjacent a recessed step surface for use by the user in passing through the access aperture (see FIG. 1). The front leg portions 122, 124 are nominally identical and respectively include angled portions 152, 154 and front leg segments 156, 158. The angled portions 152, 154 each advantageously provides a convenient hand grip surface for the user as the user passes through the access aperture.

The top rails 130, 132 can each be characterized as a substantially horizontal portion to provide a guard rail for the user as the user maneuvers on the floor surface 112 adjacent the access aperture 114 (see FIG. 1). The rear leg segments 126, 128 extend substantially vertically from the floor surface 112 adjacent the access aperture 114 to support the respective top rails 130, 132 at a first elevation above the floor surface, such as (but not limited to) about 36 inches.

The front leg portions 122, 124 are coupled to the top rails 130, 132 so that the respective angled portions 152, 154 extend downwardly at a non-orthogonal angle with respect to the substantially horizontal top rails 130, 132. The front leg segments 156, 158 extend from the floor surface to support the ends of the respective angled portions 152, 154 opposite the substantially horizontal top rails 130, 132 at a second, lower elevation above the floor surface 112, such as (but not limited to) about 18 inches. Other shapes, configurations and distances can readily be used.

The floor support brackets 140, 142, 144 and 146 respectively secure the front and rear leg segments 126, 128, 156 and 158 to the floor surface 112 adjacent the access aperture 114. Each of the brackets 140, 142, 144 and 146 are preferably nominally identical and each has a substantially L-shaped configuration.

Figure 4:
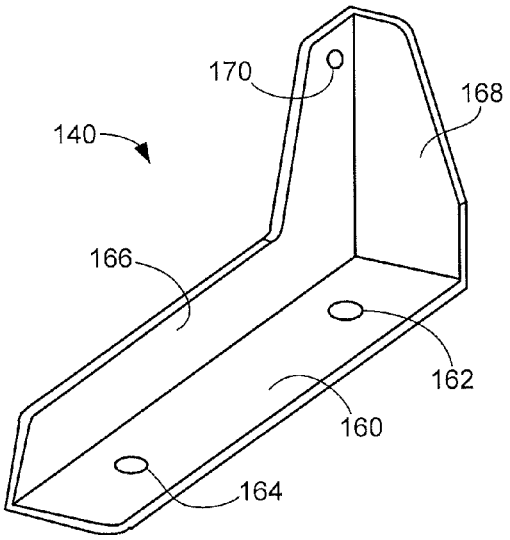
FIG. 4 illustrates a first floor support bracket of the guard rail assembly.

The bracket 140 is shown in greater detail in FIG. 4 to include a laterally extending base portion 160 with through holes (apertures) 162, 164 to accommodate fasteners therethrough to secure the bracket 140 to the floor surface. Support flanges 166 and 168 extend upwardly to nestingly receive a distal end of the associated leg segment 156, and a fastener extends through fastener aperture 170 to secure the leg segment to the bracket 140.

The support flange 166 preferably extends the entire length of the base portion 160 to serve as a strengthening rib, and is preferably aligned with an edge of the access aperture 114 to place the flange 166 in a location that is out of the way of the user, as set forth in FIGS. 1 and 2A-2B.

The stabilizer brackets 148, 150, also referred to herein as second support brackets, optionally provide further stabilization of the guard rail assembly 100. The stabilizer bracket 148 is shown in greater detail in FIG. 5 to include a second base portion 172 which, when mounted as shown in FIG. 6, extends orthogonally to the base portion 160 of the first support bracket 140. The second base portion 172 includes through apertures 174, 176 to facilitate attachment of the second bracket 148 150 to the floor surface 112.

Figure 5:
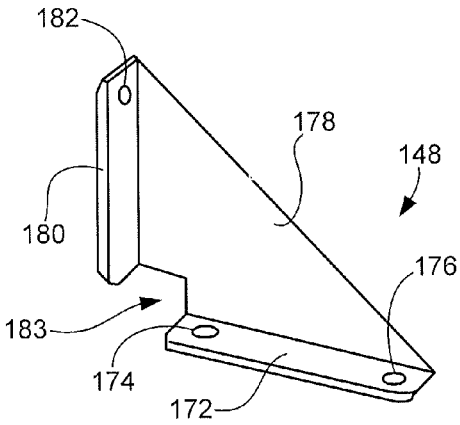
FIG. 5 illustrates a second floor support bracket preferably used in conjunction with the first support bracket.
Figure 6:
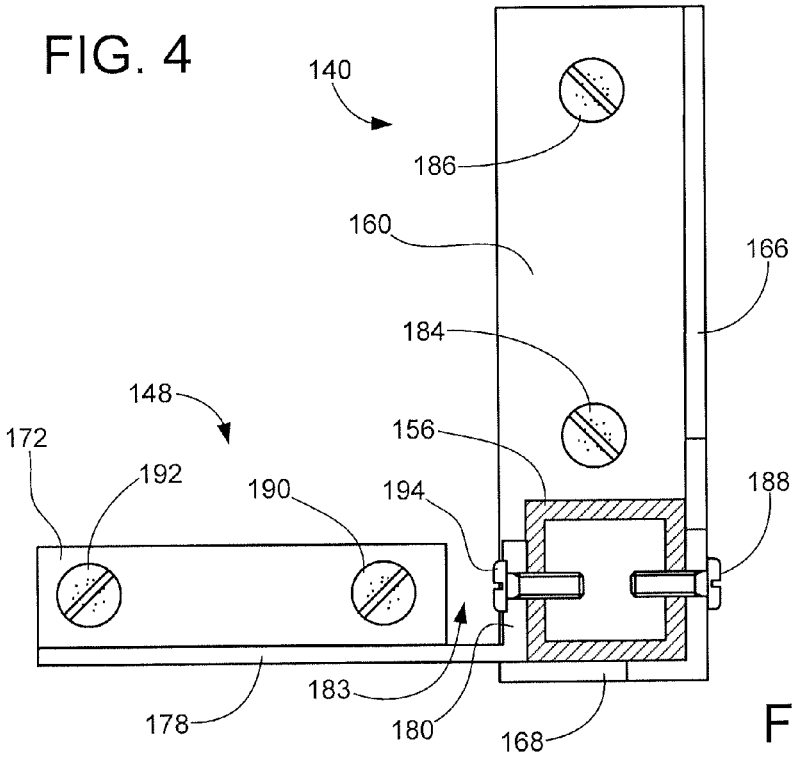
FIG. 6 shows a preferred attachment arrangement using the first and second floor support brackets.

The second support bracket 148 is further shown in FIG. 5 to include a triangular shaped web flange 178 which supports a support flange 180. The support flange 180 contactingly engages the front leg segment 156 and includes fastener aperture 182. A cutout feature (notch) of the second support bracket 150 is denoted at 183.

As shown in FIG. 6, fasteners 184, 186 extend through the respective apertures 162, 164 (FIG. 4) to secure the first support bracket 140 to the floor surface 112.

Fastener 188 extends through aperture 170 (FIG. 4) of the first support bracket 140 to engage the front leg segment 156.

Fasteners 190, 192 extend through apertures 174, 176 (FIG. 5) to secure the second support bracket 148 to the floor surface 112, and fastener 194 extends through the aperture 182 (FIG. 5) to attach the second support bracket 148 to the front leg segment 156. Similar attachments preferably take place with the other front leg segment 158, and as desired, the rear leg segments 126, 128 (FIGS. 2A-2B) as well. In this way, the first and second support brackets provide enhanced stability of the guard rail assembly 100 along multiple axes.

The various attachment members 134, 136 and 138 facilitate adjustment of the guard rail assembly 100 to accommodate different respective sizes of the access aperture 114 (FIG. 1). It has been found that different attic access apertures such as 114 can come in different sizes, such as but not limited to a smaller size of about 22.5 inches×54 inches, and a larger size of about 30 inches×60 inches. The telescopic attachment members 134, 136 and 138 are each preferably characterized as tubular sleeve members with multiple apertures that slidingly receive the respective components at different insertion depths to adjust both the length and the width of the guard rail assembly.

Figure 7A:
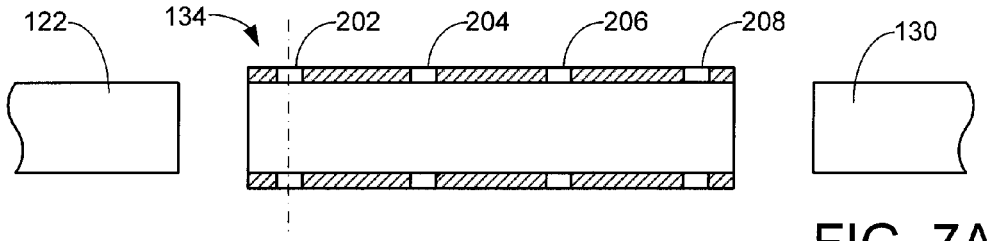
FIGS. 7A through 7C provide generalized, partial cross-sectional depictions of the use of a telescopic attachment sleeve to selectively adjust the guard rail assembly to conform to a dimension of the associated access aperture.
Figure 7B:
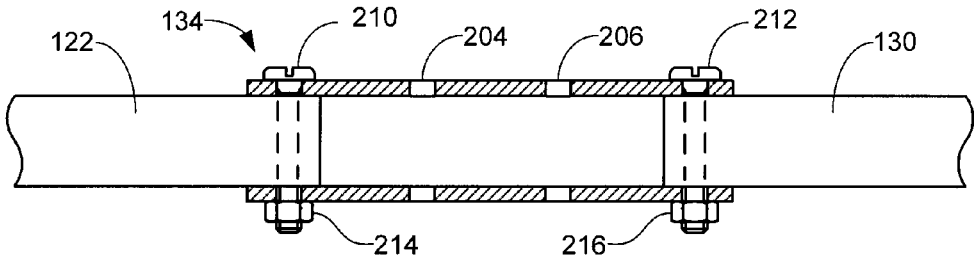
Figure 7C:
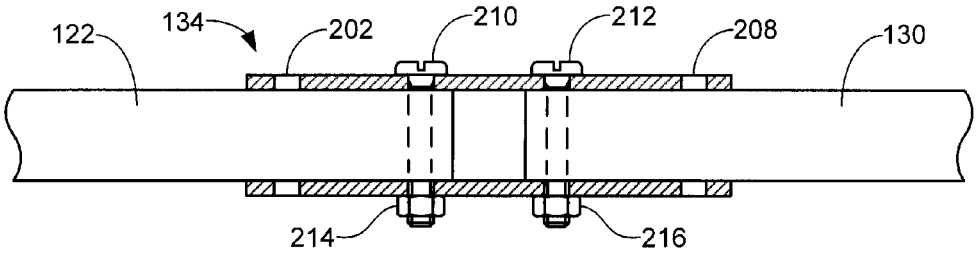

FIGS. 7A-7C generally depict this adjustability feature for a selected one of the attachment members, in this case, the attachment member 134. It will be appreciated that FIGS. 7A-7C are representative in nature and not necessarily drawn to scale.

The member 134 couples a substantially horizontal distal end of the front leg portion 122 to the top rail 130. In FIG. 7A, these respective components are shown prior to assembly. The member 134 is shown in elevational cross-section to include a plurality of selectively spaced apart adjustment apertures 202, 204, 206 and 208. These apertures preferably extend through both top and bottom sidewalls of the member 134, as shown.

FIG. 7B shows attachment of the front leg portion 122 to the top rail 130 in an extended position. More specifically, threaded fasteners 210, 212 extend through the outermost apertures 202 and 208 in the attachment member 134 to engage respective hex nuts 214, 216, thereby rigidly secure the front leg portion 122 and the top rail 130 to accommodate a longer length dimension for the access aperture 114.

FIG. 7C alternatively places the threaded fasteners 210, 212 through interior apertures 204 and 206 in the attachment member 134, thereby securing the front leg portion 122 and the top rail 130 in a retracted position to accommodate a shorter length dimension for the access aperture 114. It will be appreciated that any number of alternative arrangements can be utilized as desired, depending on the requirements of a given application.

For example, the skilled artisan will note that an intermediate position is available between the extended position of FIG. 7B and the retracted position of FIG. 7C by using one of the outermost apertures (such as the aperture 202) and one of the interior apertures (such as the aperture 206) to adjoin the respective leg portion 122 and top rail 130. Different numbers of the apertures can be used, including more or fewer apertures, and the apertures can be alternatively or additionally provided in the respective leg portion 122 and/or the top rail 130.

It will also be appreciated that the attachment member 134 can readily be configured to attach the leg portion 122 and the top rail 130 in any number of other suitable ways, including but not limited to being inserted into the ends of these respective members. The attachment member can also be provided as a flat or u-shaped flanged channel to adjoin these respective members, etc.

As noted above, the guard rail assembly 100 is preferably supplied in the form of a kit of components that are assembled on-site by the user or another party. This provides a number of advantages, including ensuring that the guard rail assembly 100 is correctly sized for the associated aperture 114, as well as eliminating any clearance issues associated with attempting to manipulate the already assembled (or one-piece) guard rail assembly 100 up through the access aperture.

A preferred assembly sequence includes connection of the rear attachment member 138 to the respective top rails 130 and 132 using suitable fasteners, thereby forming a u-shaped horizontal rail. The considerations set forth above with respect to FIGS. 7A-7C are utilized to ensure that the u-shaped horizontal rail is correctly sized for the width dimension of the associated aperture 114.

The completed u-shaped rail is preferably inverted to facilitate sliding advancement of tubular portions (not numerically designated) of the respective rear leg segments 126, 128 onto the respective top rails 130 and 132. Suitable fasteners are used to secure the leg segments 126, 128 at the desired locations. The first support brackets 144, 146 are also preferably secured to the distal ends of the rear leg segments 126, 128 at this time, as discussed above in FIGS. 4 and 6.

Next, the front leg portions 122 and 124 are adjoined to the top rails 130, 132 using the respective attachment members 134 and 136. As before, this operation takes place to accommodate the associated length dimension of the access aperture 114. The first support brackets 140, 142 are secured to the distal ends of the front leg segments 156, 158. As desired, the second support brackets 148, 150 are also attached at this time.

The completed assembly is thereafter inverted and placed appropriately so as to span the access aperture, and the remaining fasteners are installed (such as fasteners 184, 186, 190 and 192 in FIG. 6) to secure the guard rail assembly 100 to the floor surface. While in a preferred embodiment the guard rail assembly 100 is wholly supported on the floor surface 112 outside the perimeter of the access aperture, such is not necessarily required. It is expressly contemplated that some or all of the leg support segments, and/or the support brackets, can alternatively extend into or through the access aperture.

Various alternatives are additionally contemplated for other aspects of the guard rail assembly 100. For example, FIG. 8A sets forth an alternative front leg portion 222, which is generally similar to the front leg portion 122 and includes an angled portion 224 to provide a hand grip surface for the user, as before.

Figure 8A:
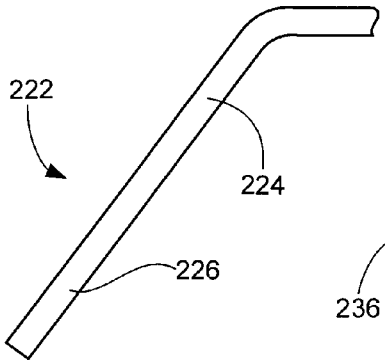
FIGS. 8A through 8C show alternative arrangements for the front leg portions of the guard rail assembly in accordance with various alternative embodiments.

However, the portion 222 in FIG. 8A further includes a front leg support 226 that is substantially aligned with and extends at the same non-orthogonal angle as the angled portion 224. From this it will be appreciated that the leg support segment does not necessarily need to extend in a substantially vertical direction in order to support the associated angled portion.

Figure 8B:
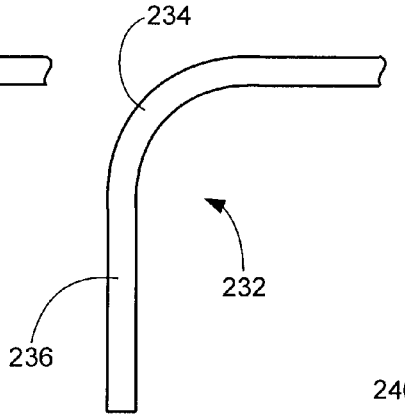

FIG. 8B provides another alternative front leg portion 232 which includes an angled portion 234 that extends non-orthogonally to the associated top rail via curvilinear extension. A substantially vertical leg support segment 236 supports the end of the angled portion 234, as before.

Figure 8C:
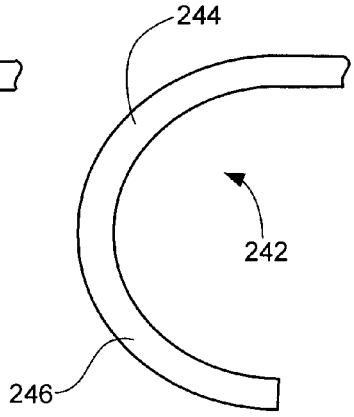

FIG. 8C provides yet another alternative front leg portion 242 with both an angled portion 244 and a leg support segment 246 that continuously, curvilinearly extend as shown. Any number of other configurations will readily occur to the skilled artisan in view of the present disclosure, and can be easily implemented depending on the requirements of a given application.

Figure 9:
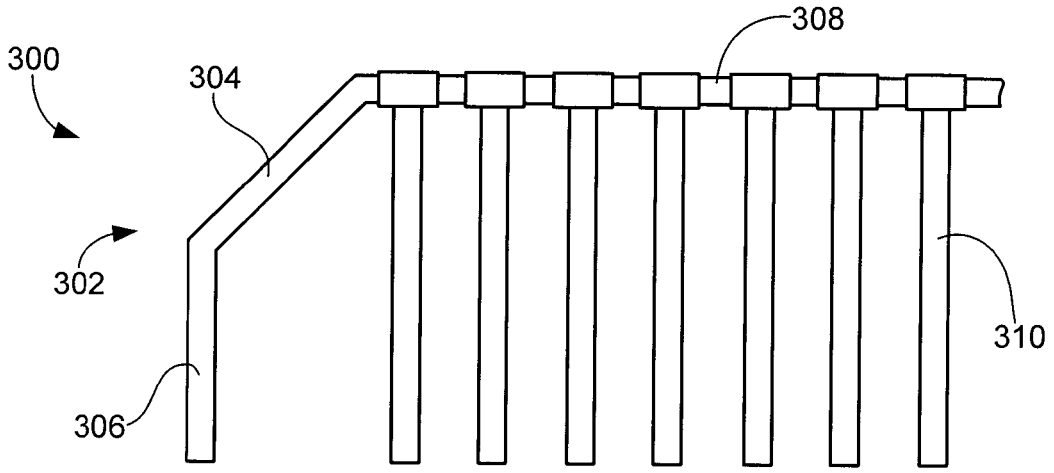
FIG. 9 provides a side elevational depiction of an alternative guard rail assembly configuration with the use of additional rail slats to provide a protective barrier.

FIG. 9 generally depicts another alternative guard rail assembly 300 generally similar to the guard rail assembly 100 discussed above. The guard rail assembly 300 generally includes a front leg portion 302 with angled portion 304 and front leg support segment 306. The front leg portion 302 adjoins a substantially horizontal top rail 308. It will be noted that the guard rail assembly 300 generally utilizes sharper angular transitions between successive segments as compared to the assembly 100; this is merely for purposes of illustrating an alternative embodiment.

The guard rail assembly 300 further generally includes a plurality of adjacent rail supports 310 which are closely spaced together as shown. The rail supports provide additional support for the top rail 308, as well as to provide protection slats to form a protective barrier that closes off the space bounded by the front leg portion 302 and the top rail 308. Any number of alternative configurations can be utilized, including additional slats that depend down from the angled portion 304.

Figure 10:
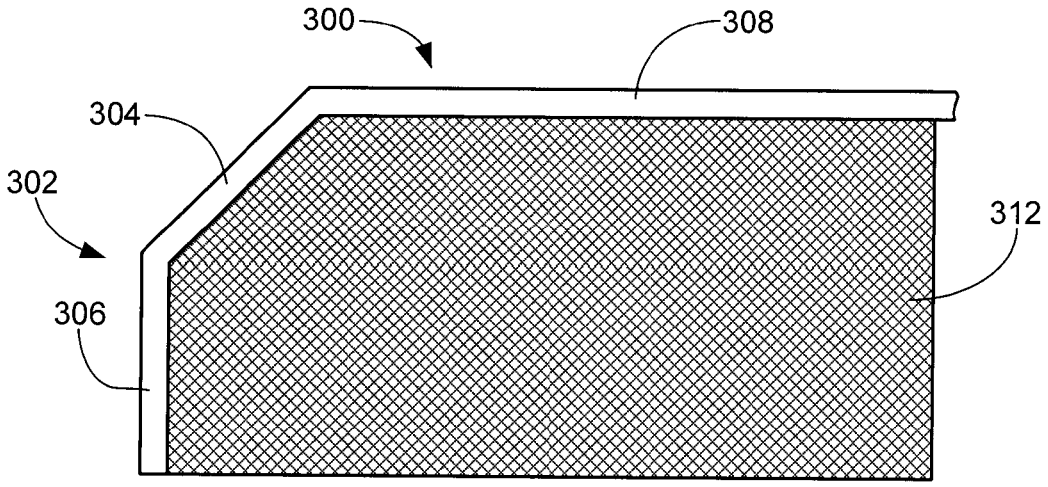
FIG. 10 shows another alternative guard rail assembly configuration with the use of a protective mesh or similar material as a protective barrier.

FIG. 10 presents an alternative depiction of the guard rail assembly 300 with the use of a screen mesh 312 as a protective barrier to close off the aforementioned space. The mesh 312 can be formed from a suitable material, such as metal or plastic, with either a closed or open weave to prevent or restrict vision and airflow therethrough. While the mesh 312 can be formed so as to provide support for the top rail 308, it is contemplated that one or more rail supports (such as depicted in FIG. 9) will be additionally utilized for this purpose.

Figure 11:
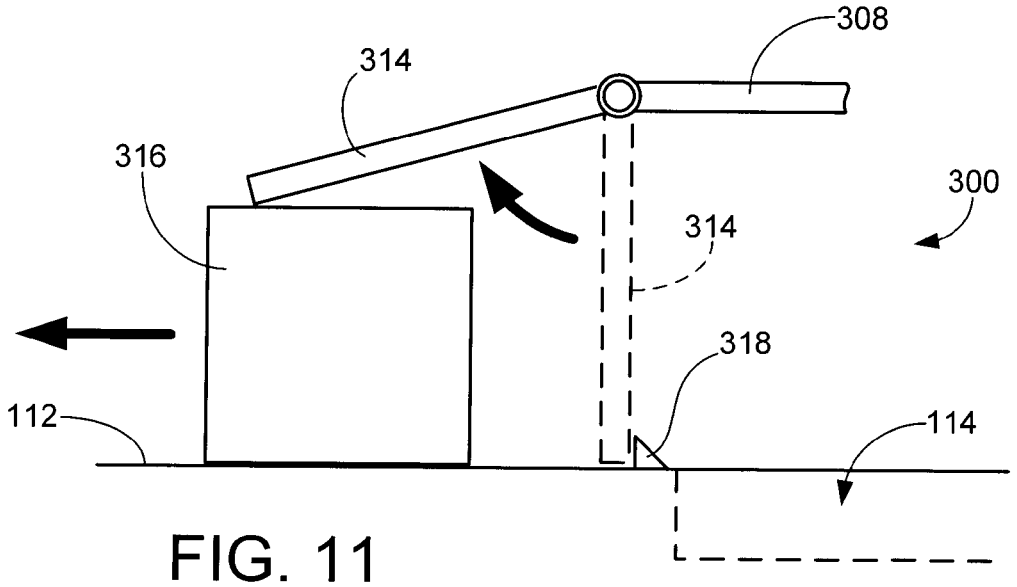
FIG. 11 illustrates another alternative guard rail assembly configuration in which a protective member is rotatably deflectable to facilitate movement of an object by the user to or from the exemplary attic space.

FIG. 11 provides yet another alternative embodiment for the guard rail assembly 300. For reference, FIG. 11 generally orients the assembly 300 so as to be viewed from the front, rather than the side as in FIGS. 9 and 10.

In the embodiment of FIG. 11, one or more pivotal guard members 314 are provided as a protective barrier, as before. In addition, the pivotal members 314 are configured so as to pivot or otherwise move with respect to the top rail 308. Such movement is restricted to a direction away from the access aperture 114, to permit sliding movement of an object (such as box 316) along the floor surface 112 as shown. A limit stop member 318 preferably prevents movement of the member 314 in the opposite direction (toward the access aperture). A retention mechanism, such as a latch or a magnet (not shown), can be used to provide a bias force to normally retain the member 314 adjacent the limit stop member 318.

The embodiment of FIG. 11 provides the advantages of the slats or mesh of FIGS. 9 and 10 with regard to protecting a user from falling through the enclosed space and into the access aperture 114, while at the same time enhancing the ability of a user to carry an object such as 316 up through the access aperture and, while still positioned therein, to laterally slide the object 316 across on the floor surface 112. Various other alternative configurations will readily occur to the skilled artisan in view of the foregoing discussion, so the various embodiments presented herein are merely exemplary and not limiting.

It will now be appreciated that the various embodiments discussed herein present several advantages over the prior art. The exemplary guard rail assembly provides a secure, easily constructed and adaptable railing structure to reduce the risk of fall of a user through an access aperture.

The preferred use of the angled portions of the guard rail assembly provide sturdy and conveniently placed hand grip surfaces for a user ascending or descending through the access aperture. As the user ascends, the user can grasp one or both of the angled portions to steady the user as the user steps off of the stairs and onto the floor space. The angled portions can be similarly used when the user descends from the attic space. The angled portions are particularly useful when the user is moving an object to or from the attic space, as the hand grip surfaces can be used to ensure stability of the user in the vicinity of the top of the stairway.

The provision of the guard rail assembly in a kit form advantageously facilitates on-site assembly, thereby eliminating clearance problems associated with lifting and maneuvering the completed guard rail assembly through the access aperture. Similarly, the adjustment features of the guard rail assembly advantageously accommodate different sizes of access aperture, and ensure that the guard rail assembly, when completed, will be correctly sized for the associated aperture.

The guard rail assembly can be used with any number of access apertures without interfering with existing features of the aperture, such as the aforementioned retractable stairs often used with attic spaces. The attachment of the guard rail assembly to the floor surface adjacent the access aperture as embodied reduces trip hazards or other clearance issues, while providing the necessary security and structural rigidity to serve as an effective guard rail system.

While not required, the various additional features to enclose the spaces between the top rails and the floor surface, such as via slats or mesh, can advantageously provide additional protection for the user, as desired. The moveable slats or other protection members can further facilitate ease in moving objects from the stairs and onto the floor surface.

While presently preferred embodiments are directed to a guard rail assembly for use in a residential structure to provide a guard rail around an attic access aperture, it will be appreciated that such is not limiting. Rather, the various embodiments presented herein can be adapted for any number of interior or exterior environments, including but not limited to roofs, lofts, streets and other structures.

While the exemplary access aperture has been disclosed herein as substantially rectilinear in shape, such is also merely for convenience as the access aperture and/or the overall circumferential extent of the guard rail assembly can take any number of shapes, including round, square, etc. Also while it is preferred that the guard rail assembly take substantially the same shape as the access aperture, such is also not necessarily required; for example, the exemplary guard rail assembly as set forth herein could be readily adapted to protect a round access aperture, etc.

While it is preferred that both the floor surface and the top rail be parallel to each other, such is not necessarily required, since it is contemplated that some applications may be suited to other respective arrangements. Moreover, while the various embodiments presented herein provide both a substantially horizontal floor surface and substantially horizontal top rails, such are also not necessarily required. A sloped roof or floor surface, for example, may merit the use of a substantially horizontal or a similarly sloped top rail, and vice versa.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A guard rail assembly comprising:

a top rail portion which extends adjacent at least one side of an access aperture to provide a guard rail for a user maneuvering on a floor surface adjacent the access aperture;

an angled portion which extends downwardly from the top rail portion at a non-orthogonal angle with respect to the top rail portion to provide a hand grip surface for the user as the user passes through the access aperture;

a front leg segment having opposing lower and upper ends, the lower end disposed adjacent the floor surface and the upper end extending above the lower end to support an end of the angled portion opposite the top rail portion; and first and second support brackets configured to receive and engage the lower end of the front leg segment to provide multi-axial support thereto along two orthogonal axes, the first support bracket comprising a first planar base portion which contactingly engages the floor surface and a first planar support flange which orthogonally extends from an edge of the first planar base portion to contactingly engage a first vertical side of the front leg segment, the second support bracket comprising a second planar base portion which contactingly engages the floor surface and a second planar support flange which orthogonally extends from an edge of the second planar base portion to contactingly engage a second vertical side of the front leg segment, each of the first and second planar base portions having a length longer than a width thereof, the first planar base portion extending away from the front leg support so that the length of the first planar base portion extends in a first direction along an edge of the access aperture, the second planar base portion extending away from the front leg support so that the length of the second planar base portion extends in a second direction orthogonal to the first direction and away from the access aperture to contactingly engage, with the first planar base portion, a substantially L-shaped area of the floor surface, and wherein an end of the first planar base portion is disposed under the lower end of the front leg segment; and wherein the second support bracket has a cutout feature configured to insertingly accommodate a portion of the first support bracket to enable both the first and second support brackets to respectively lie flat on the floor surface during said engagement with the lower end of the front leg segment without extending into said access aperture.

2. The guard rail assembly of claim 1, further comprising a rear leg segment which extends from the floor surface to support the top rail portion at a first elevation thereabove, wherein the upper end of the front leg segment supports the end of the angled portion opposite the top rail portion at a different, second elevation thereabove.

3. The guard rail assembly of claim 2, wherein the top rail portion, the rear leg segment, the angled portion and the front leg segment collectively form a first side rail assembly mountable adjacent a first side of the access aperture, and wherein the guard rail assembly further comprises a second side rail assembly substantially identical to the first side rail assembly mountable in mirrored relation thereto adjacent an opposing second side of the access aperture.

4. The guard rail assembly of claim 3, further comprising an attachment member interposed between the first and second side rail assemblies to collectively form a substantially u-shaped guard rail that surrounds three sides of the access aperture.

5. The guard rail assembly of claim 3, wherein the attachment member facilitates respective extension or retraction of the first side rail assembly with respect to the second side rail assembly to accommodate different access aperture widths from the first side to the opposing second side thereof.

6. The guard rail assembly of claim 1, further comprising an attachment member which attaches the angled portion to the top rail portion to facilitate respective extension or retraction of the top rail portion with respect to the angled portion to accommodate different access aperture lengths.

7. The guard rail assembly of claim 6, wherein the attachment member is characterized as a telescopic attachment sleeve with opposing ends into which the angled portion and the top rail portion respectively slidingly extend.

8. The guard rail assembly of claim 6, wherein at least a selected one of the attachment member, the angled portion or the top rail portion is provided with a plurality of spaced apart apertures to accommodate at least two different access aperture lengths in relation to which of said apertures respective fasteners are disposed.

9. The guard rail assembly of claim 1, wherein the angled portion extends substantially linearly at a selected angle between the top rail portion and the front leg segment.

10. The guard rail assembly of claim 1, wherein the angled portion extends in substantially curvilinearly between the top rail portion and the front leg segment.

11. The guard rail assembly of claim 1, wherein the front leg segment and the rear leg segment each extend substantially vertically from the floor surface to the respective angled portion, and wherein the top rail extends in a substantially horizontal direction.

12. The guard rail assembly of claim 1, wherein the access aperture is characterized as an attic access aperture to provide access to an attic space, wherein at least one step is provisioned adjacent one side of the access aperture for the user to step on while ascending or descending through the access aperture, wherein a selected one of the first or second support brackets comprises an elongated planar member configured to be secured to the floor surface in alignment with an edge of the attic access aperture, and wherein no portion of the guard rail assembly extends into said attic access aperture.

13. A kit for forming a guard rail assembly adjacent an access aperture which vertically extends through a horizontal floor surface, the access aperture being substantially rectangular with a front access edge, a rear edge and opposing side edges between the front access edge and the rear edge, the kit comprising:

a top rail portion which extends adjacent at least one side of an access aperture to provide a guard rail for a user maneuvering on the floor surface adjacent the access aperture;

an angled portion which extends downwardly from the top rail portion at a non-orthogonal angle with respect to the top rail portion to provide a hand grip surface for the user as the user passes through the access aperture;

a front leg segment having opposing lower and upper ends, the lower end disposed adjacent the floor surface and the upper end supporting an end of the angled portion opposite the top rail portion at a second elevation above the floor surface, wherein the respective top rail portion, the angled portion and the front leg segment are configured to be assembled together above the floor surface to provide the guard rail assembly for the access aperture; and separate first and second support brackets configured to respectively engage the lower end of the front leg segment to provide multi-axial support for the guard rail assembly, the first support bracket comprising a first base portion which extends between the lower end of the front leg segment and the floor support surface to contactingly engage the floor support surface immediately adjacent and parallel to a selected side edge of the access aperture without extending into or over said access aperture, the second support bracket comprising a second base portion contactingly engaging the floor support surface and having a greater length dimension and a smaller width dimension, the greater length dimension extending orthogonally away from the side edge of the access aperture so as to be substantially aligned with the front access edge of the access aperture; and wherein the second support bracket comprises a clearance notch configured to facilitate placement of a portion of the second support bracket adjacent the first support bracket, the first support bracket further comprising first and second support flanges, the first support flange extending vertically from the selected side edge of the first base portion to contactingly engage a side of the lower end of the front leg segment, the second support flange extending vertically from a second edge of the base portion and adjoining the first support flange, the first and second support flanges together with the base portion to receive supporting the lower end of the first front leg segment above the base portion.

14. The kit of claim 13, further comprising an attachment member which attaches the angled portion to the top rail portion to facilitate respective extension or retraction of the top rail portion with respect to the angled portion to accommodate different access aperture lengths.

15. The kit of claim 14, wherein the attachment member is characterized as a telescopic attachment sleeve with opposing ends which slidingly engage the respective angled portion and the top rail portion.

16. The kit of claim 15, wherein at least a selected one of the attachment member, the angled portion or the top rail portion is provided with a plurality of spaced apart apertures to accommodate at least two different access aperture lengths in relation to which of said apertures respective fasteners are disposed.

17. The kit of claim 13, further comprising a protective barrier disposed between the top rail and the floor surface to provide a barrier between the access aperture and an adjacent portion of the floor surface.

18. The kit of claim 17, wherein the protective barrier comprises a plurality of spaced apart slat members.

19. The kit of claim 17, wherein the protective barrier comprises a mesh.

20. The kit of claim 17, wherein the protective barrier is configured to pivot with respect to the top rail portion to facilitate lateral movement of an object by the user under the top rail portion in a direction away from the access aperture adjacent the floor surface.

21. The kit of claim 13, wherein the floor surface is characterized as a floor surface of an attic space, and the access aperture is characterized as an attic access aperture.

22. A guard rail assembly, comprising:

a top rail portion which extends adjacent at least one side of an access aperture to provide a guard rail for a user maneuvering on a floor surface adjacent the access aperture;

a leg segment which supports the top rail portion; and a support assembly which supports the leg segment with respect to the floor surface, comprising:

a first support bracket comprising a first base portion which extends in a first direction in contacting engagement with the floor surface for attachment thereto immediately adjacent a side edge of the access aperture and parallel thereto, and a first support flange extending from the first base portion to abuttingly support a first side of a distal end of the leg segment, wherein an end of the first base portion is disposed under a lowermost end of the leg segment so as to be axially between said lowermost end of the leg segment and the floor surface; and a second support bracket comprising a second base portion which extends in a different, second direction in contacting engagement with the floor surface for attachment thereto, and a second support flange extending from the second base portion to abuttingly support a different, second side of the distal end of the leg segment, thereby providing multi-axial stability for the top rail portion;

wherein the first base portion is configured to extend with a longest length thereof substantially parallel to the selected side edge of the access aperture, and wherein the second base portion is configured to extend with a longest length thereof in a direction substantially perpendicular to the selected side edge and substantially parallel to a front edge of the access aperture orthogonal to the selected side edge; and wherein the second support bracket has a cutout feature configured to insertingly accommodate a portion of the first support bracket to enable both the first and second support brackets to respectively lie flat on the floor surface during said engagement with the lower end of the front leg segment without extending into said access aperture.

23. The guard rail assembly of claim 22, wherein the first support bracket further comprises a third support flange which extends from the first support flange to abuttingly support a different, third side of the distal end of the leg segment.

24. The guard rail assembly of claim 22, wherein the first base portion and the second base portion cooperate to cover a substantially L-shaped area of the floor surface.

25. The guard rail assembly of claim 22, further comprising an angled portion which extends from the top rail portion at a non-orthogonal angle with respect to the top rail portion to provide a hand grip for the user as the user passes through the access aperture over the front edge thereof, wherein the leg segment is connected to a selected end of the angled portion opposite the top rail portion.

26. The guard rail assembly of claim 25, further comprising an attachment member which attaches the angled portion to the top rail portion to facilitate respective extension or retraction of the top rail portion with respect to the angled portion to accommodate different access aperture lengths.

27. The guard rail assembly of claim 22, wherein the floor surface is characterized as a floor surface of an attic space, and the access aperture is characterized as an attic access aperture.

* * * * *